US005254229A

United States Patent [19]

Ohmi et al.

[11] Patent Number: 5,254,229

[45] Date of Patent: Oct. 19, 1993

[54] ELECTRIFIED OBJECT NEUTRALIZING METHOD AND NEUTRALIZING DEVICE

[75] Inventors: Tadahiro Ohmi, 1-17-301, Komegabukuro 2-chome, Aoba-ku, Sendai-shi, Miyagi-ken 980; Hitoshi Inaba, Machida, both of Japan

[73] Assignee: Tadahiro Ohmi, Miyagi, Japan

[21] Appl. No.: 651,264

[22] Filed: Apr. 10, 1991

[30] Foreign Application Priority Data

Aug. 18, 1989 [JP] Japan ..... 1-212145
Dec. 26, 1989 [JP] Japan ..... 1-335211

[51] Int. Cl.[5] ..... C25F 1/00; H05F 3/06

[52] U.S. Cl. ..... 204/157.15; 204/141.5; 361/213

[58] Field of Search ..... 204/140, 141.5, 151.15, 204/158.2; 361/213

[56] References Cited

U.S. PATENT DOCUMENTS 4,827,371 5/1989 Yost ..... 361/213

FOREIGN PATENT DOCUMENTS 4021303 9/1965 Japan .
43-25505 10/1968 Japan .
58-93323 6/1983 Japan .
61-138630 12/1984 Japan .

OTHER PUBLICATIONS

Chemical Abstract 110:40407j.
RCA Technical Note, TN No. 1214, Sep. 1, 1978.

*Primary Examiner*—John Niebling
*Assistant Examiner*—Brian M. Bolam
*Attorney, Agent, or Firm*—Baker & Daniels

[57] ABSTRACT

The present invention relates to an electrified object neutralizing method and a neutralizing device.

The present invention is characterized in that electrons are made released by means of a photoelectric effect, negative ions are generated by making the released electrons combine with gas-state atoms or molecules, and positive electric charge in an electrified object is neutralized by the negative ions. With the features, electrification of an object can be prevented without contaminating the object.

3 Claims, 5 Drawing Sheets

ELECTRIFIED OBJECT NEUTRALIZING METHOD AND NEUTRALIZING DEVICE

TECHNOLOGICAL FIELD OF THE INVENTION

This invention relates to an electrified object neutralizing method and a neutralizing device, and more particularly to an electrified object neutralizing method and a neutralizing device which allows neutralization of an electrified object without contaminating the electrified object.

BACKGROUND OF THE INVENTION

In an LSI manufacturing process, electrification of a wafer is a big problem, and it is urgently required to establish a technology for prevention of electrification.

Description is hereunder made for troubles caused by electrification of a wafer, as an example of an electrified object.

As a wafer is generally handled with insulating fluororesin or quartz for preventing it from being contaminated, a very high electric potential is charged when it contacts something during handling. Results of measurement of electric potential in electrified wafers are shown in Table 1 below.

TABLE 1

| Electrical potential in an electrified wafer |
|---|
| When handled by teflon forceps |
| . . . +500 V ~ +3300 V or more |
| When put on a polypropylene stand |
| . . . +600 V ~ +2000 V |
| When a wafer is put on a quartz plate with teflon forceps |
| . . . +1000 V ~ +1500 V |

A range of measurement by an electrometer = −3300 V ~ +3300 V.

As shown by this result, it has turned out that, when a silicon wafer is handled by resin materials or quartz, always positive electricity is charged in the wafer because of the electrification column, and also that the electric potential is fairly high.

Also it has turned out that, when a wafer is electrified, two types of trouble as shown below are caused and it is a big cause for substantial decrease in yield in a semiconductor manufacturing process:

(1) Adhesion of airborne particles due to electrostatic force.

(2) Breakage of a device due to discharge of static electricity.

Results of testing as well as results of computing to identify the trouble (1) are introduced below. FIG. 1 shows a number of particles with the diameter of 0.5 μm or more which adhered to a surface of an electrified wafer when a 5-inch wafer is left on a conductive grating floor for 5 to 10 hours in a clean room in the vertical position with a 2 cm high insulating stand. The horizontal axis shows electric potentials in the wafer, and the vertical axis shows a number of deposited particles (converted to a number of particles which adhered to a central area of a wafer when the wafer is left for 5 hours in the atmosphere with the density of 10 particles with the diameter of 0.5 μm or more /cf). As adhesion of particles due to gravity does not occur on a vertical surface, adhesion of particles is not observed when electric potential of a wafer is in a low range from 0 V-50 V. In accordance with increase of electric potential of the wafer to 300 V or to 1800 V, the number of adhered particles sharply increases, which shows that the adhesion is caused by a static electricity force. FIG. 1 shows a case where effects of static electricity force to relatively large particles were measured, and generally as diameter of a particle becomes smaller, the effects of this static electricity force become visible accelerative-ly. When electric potential of a wafer is at least 50 V or below, any particle deposits on it. Herein, a state where electric potential of a wafer is 50 V or below is defined as a state where electric potential of the wafer has been neutralized. FIG. 2 shows a range of movement of particles moved and adhered due to static electricity force on an effective section of a wafer calculated on the assumption that electric potential of the wafer is 1000 V and electric potential at the peripheral rectangular frame line is zero. As a force to deposit particles, only gravity (including buoyancy) and static electricity force are taken into account. Also it is assumed that the particle density is 1 g/cm$^3$. This figure shows that particles in an area enclosed by oblique lines adhere to the effective section of the wafer. Results of the calculation show that an area where particles with the diameter of 2 μm or more adhere to is very narrow, which shows that virtually no particle adheres to the wafer. As the pareticle diameter becomes smaller to 0.5 μm or 0.1 μm, the adhesion area sharply becomes larger, which indicates that, when diameter of a particle is small, the effect of static electricity force over the particle in terms of adhesion to a surface of an object is very large.

Results of the experiment and calculation described above indicates that prevention of electrification of a wafer is very important for preventing a surface of the wafer from being contaminated by particles.

Conventional art for prevention of electrification of a wafer is classified to the following two ways.

(1) Generating ions by means of the corona discharge method and neutralizing an electrified wafer with the ions.

(2) Neutralizing an electric charge in a wafer by handling the wafer with a grounded conductive resin material.

(3) Neutralizing an electric charge in a wafer by handling the wafer with a grounded metallic material.

All of these techniques have defects which may be fatal in the age of submicron ULSI, and unless these defects are removed, they are not applicable for neutralization of enhanced wafers.

It has turned out that the corona discharge in (1) above has the following problems.

(1) Generation of corpuscles from a tip of a discharging electrode (2) Generation of ozone This inventor investigated a cause for (1), and found out that spattering due to ions occurs at a tip of a discharging electrode and corpuscles are generated because of this phenomenon. FIG. 3 shows numbers of ions and corpuscles (≧0.17 μm) generated when spark discharge is performed by using a tungsten needle. The numbers of generated ions and corpuscles vary according to strength of loaded discharge current, and when a current value is 1 mA, positive ions are generated at a rate of 200 millions pcs/sec with particles with the diameter of 0.17 μm or more generated at a rate of 1960 pcs/sec. It is conceivable that particles with smaller diameter are generated at a higher rate. As this experiment result shows a case of spark discharge, it is conceivable that a quantity of dust generated in corona discharge would be smaller. But, as spattering, which is the same phenomenon as that in case of spark discharge, occurs, the possibility of dust generation can not be denied.

Then, ozone in (2) is generated when air is electrolytically dissociated, and as ozone's oxidizing effect is very strong, a oxidized film is rapidly formed on a surface of a wafer, which causes various troubles. Also, it has turned out that high polymer materials often used as, for instance, coating material for power cables are dissolved by ozone, which causes many troubles such as insulation fault. Unless these problems are solved, an electrified surface neutralizing method making use of ions generated by means of corona discharge can not be applied for wafers.

In the method (2), a conductive substance mixed with a resin material is a source of contaminants for wafers. Generally carbon or metal is used as a substance to be mixed with. When the substance contacts a wafer, the impurities adhere to the wafer, which causes a dark current or a leak current.

Also in the method (3), like in the method (2), conductive metal contacts a wafer, which may generate a dark current or a leak current (contamination by metal) causing severe contamination, so that the method is not applicable for production of wafers unless it is improved.

SUMMARY OF THE INVENTION

An electrified object neutralizing method according to this invention is characterized in that electrons are released by making use of a photoelectric effect and the released electrons are made combined with gas-state atoms or molecules to generate negative ions, and in that positive electric charge of an electrified object is neutralized by the negative ions.

An electrified object neutralizing device according to this invention is characterized in that said device has at least a means for generating electrons by means of a photoelectric effect, a means for irradiating ray to said means for generating electrons, a means for generating negative ions by making the released electrons combined with gas-state atoms or molecules, and a means for neutralizing the electric charge of an electrified object with the negative ions.

Electrons are released by irradiating a ray onto a surface of an object (a photoelectric effect), and gas-state atoms or molecules are ionized by making use of the released electrons. A wavelength of light may be selected so that energy of the light is higher than ionizing energy of an irradiated object. Also, if atmosphere for generation of ions is air, an upper limit of a wavelength may be specified appropriately. Furthermore, if composition of ions is a problem, negative ions should be generated in high purity gas atmosphere which does not contaminate a neutralized object even it adheres to the neutralized object. Ions to be generated are only negative ions, but neutralization of a positive electrical charge can be made only with negative ions. As described in relation to electrification of a wafer, a wafer is usually handled with a handling tool made of resin or quartz and as electrication polarity of the wafer is always positive only negative ions are required to neutralize the wafer. Also, as polarity of generated ions is biased, life span of the ions is longer than that when positive ions and negative ions coexist, which means that the generated ions are used efficiently for neutralization of an electrified object. Note that, although there may be a concern for reverse electrification by the ions because polarity of the ions is biased, actually almost no problem occurs. Conditions for reverse electrification vary according to the border conditions between an electrified object and 0 V around the object, and if, for instance, an automatic transfer tunnel for a silicon wafer is assumed, as a border of the 0 V area is very close to the wafer, adhesion of ions to the wafer is stopped at an electric potential level because repelling power due to static electricity works even if reverse electrification due to ions occurs, and the electric potential becomes low. When this invention is applied as spattering, which generates corpuscles, does not occur, generation of particles can be suppressed completely. FIG. 3 shows numbers (an example) of ions and corpuscles ($\geqq 0.17$ μm) generated when an ion generating method making use of a photoelectric effect is applied. In this example, the light source is a Xe lamp which emits various types of light including an untraviolet with a single wavelength of 0.2 μm, and irradiation of light was made to an aluminum surface. The flowing gas is the air in a clean room. In this example, negative ions are generated at a rate of 20 millions pcs/sec, while no corpuscle is generated at all. Although positive ions are generated in this case, these ions are generated because impurities in the air release electrons due to a photoelectric effect. Also, generation of ozone can be suppressed by controlling a wavelength of a ray used for irradiation or eliminating $O_2$ from the atmosphere in which the ions are generated.

DETAILED DESCRIPTION OF A PREFERRED EMBODIMENT

In the above drawings, 1 is irradiation of an ultraviolet ray, 2 is an aluminum chamber, 3 is an electrified object (a silicon wafer), 4 is a wafer neutralizing chamber, 5 is an air flow (Velocity: 0.1 m/sec), 21 is an ion generating device 22 is an ultraviolet ray emitting lamp, 23 is metallic mesh (from which electrons are released because of a photoelectric effect), 24 is a gas source for negative 25 is $N_2$ gas, 26 is a wafer, 27 is an insulator, and 28 is an ion analyzer.

Description is hereunder made for embodiments of the present invention.

Figure 1:
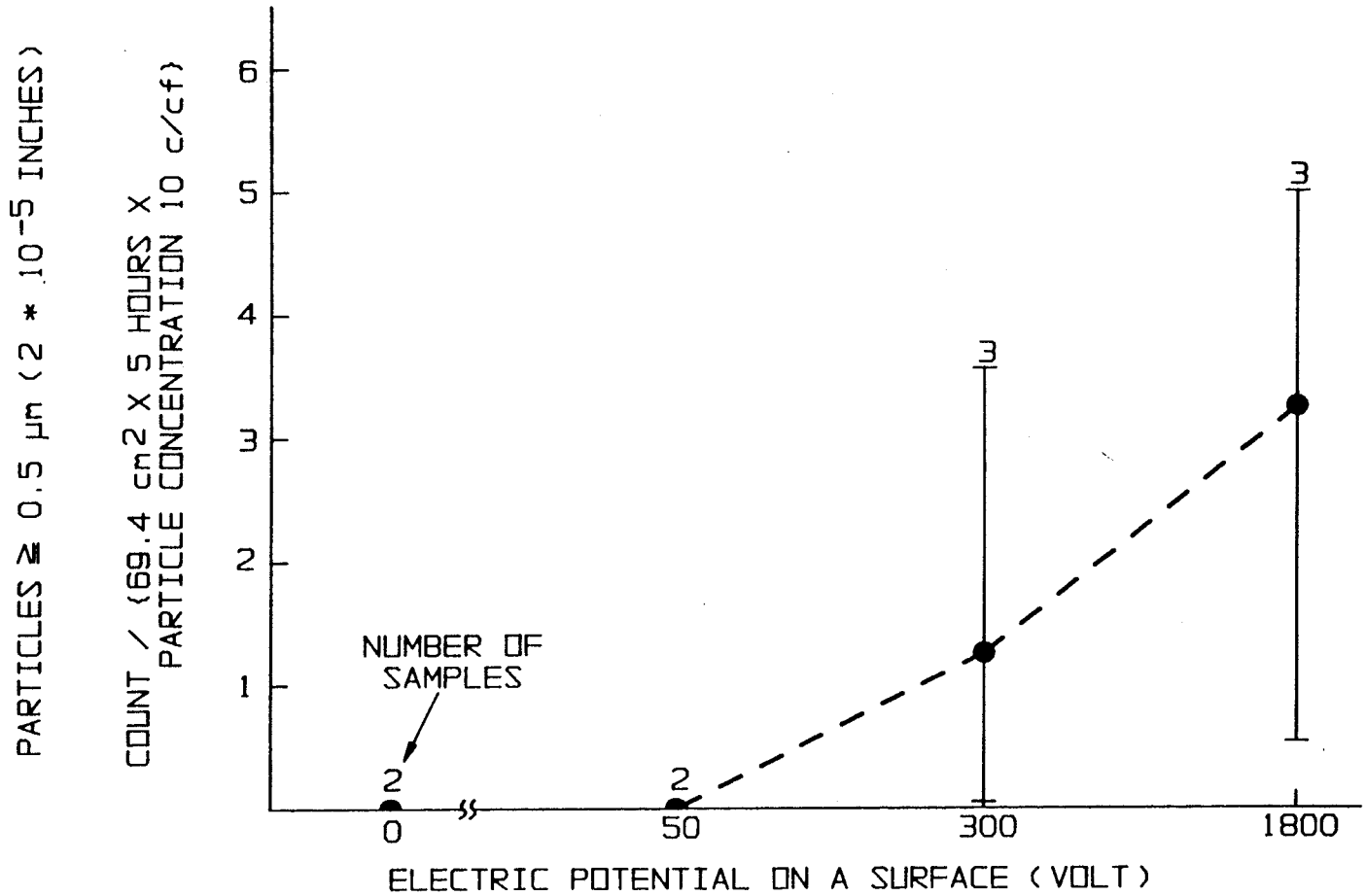
FIG. 1 is a graph showing results of a experiment to check adhesion of particles to an electrified wafer.
Figure 2:
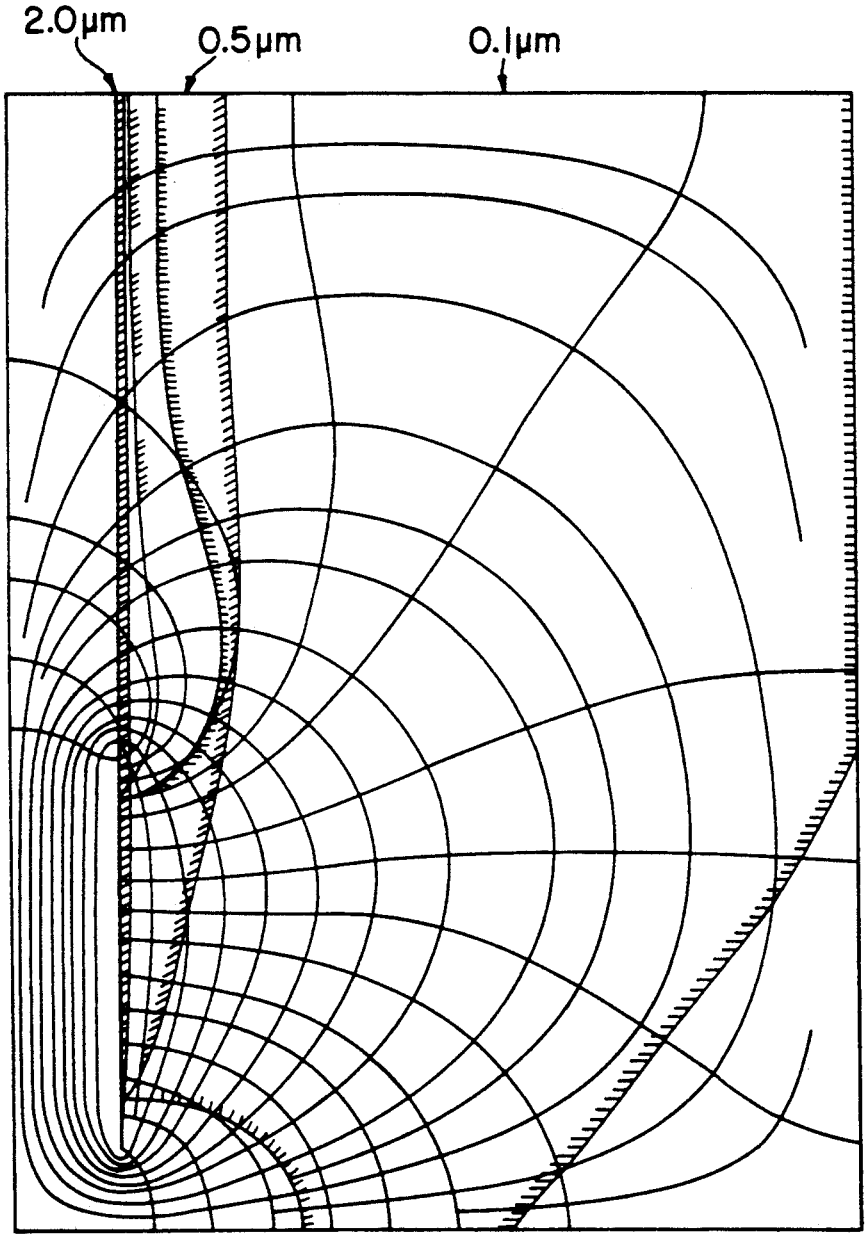
FIG. 2 shows a result of a calculation on adhesion of particles to an electrified wafer.
Figure 3:
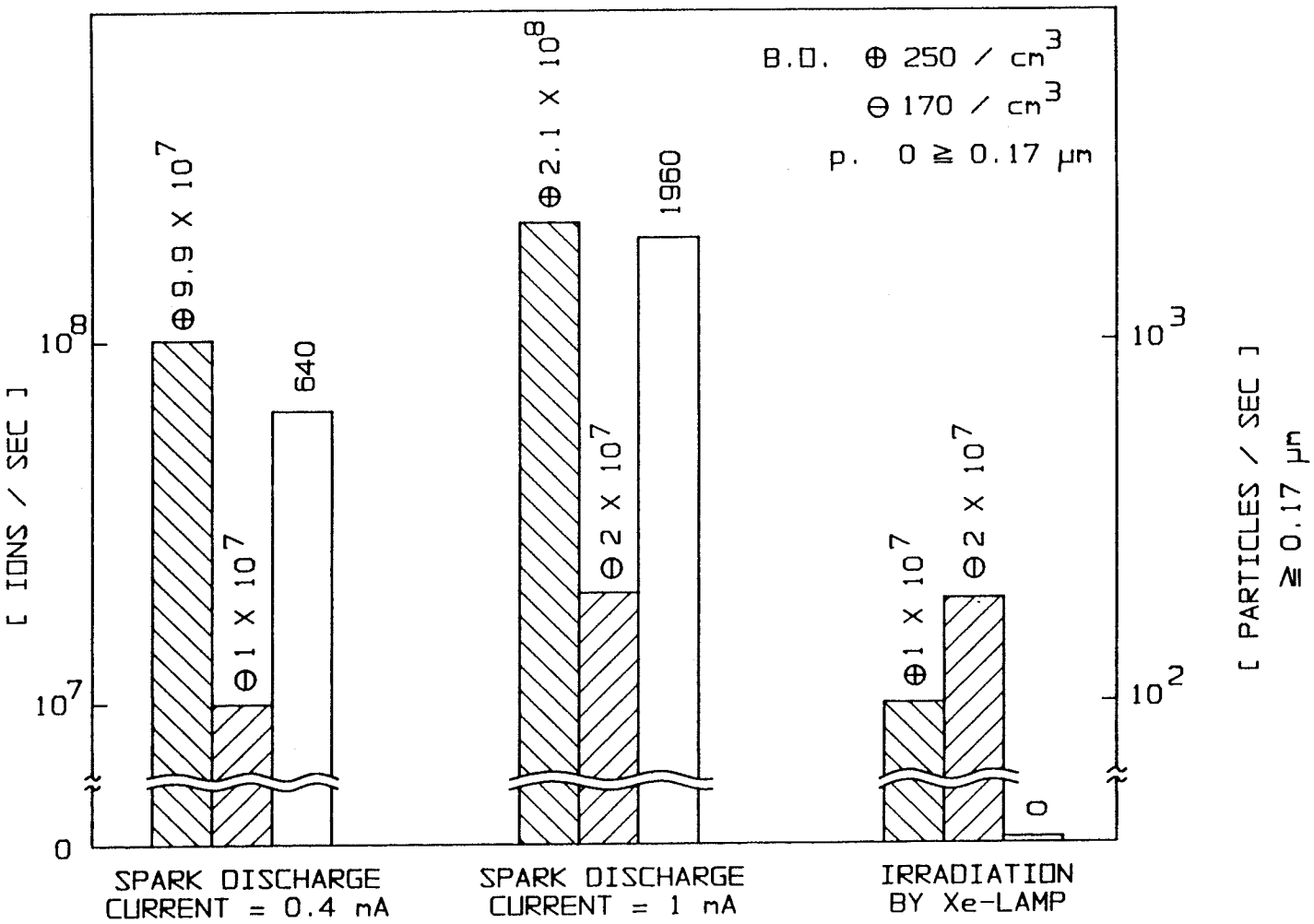
FIG. 3 is a graph showing a number of ions and corpuscles generated by means of the ion generating method making use of electric discharge and by means of the ion generating method making use of a photoelectric effect.
Figure 4:
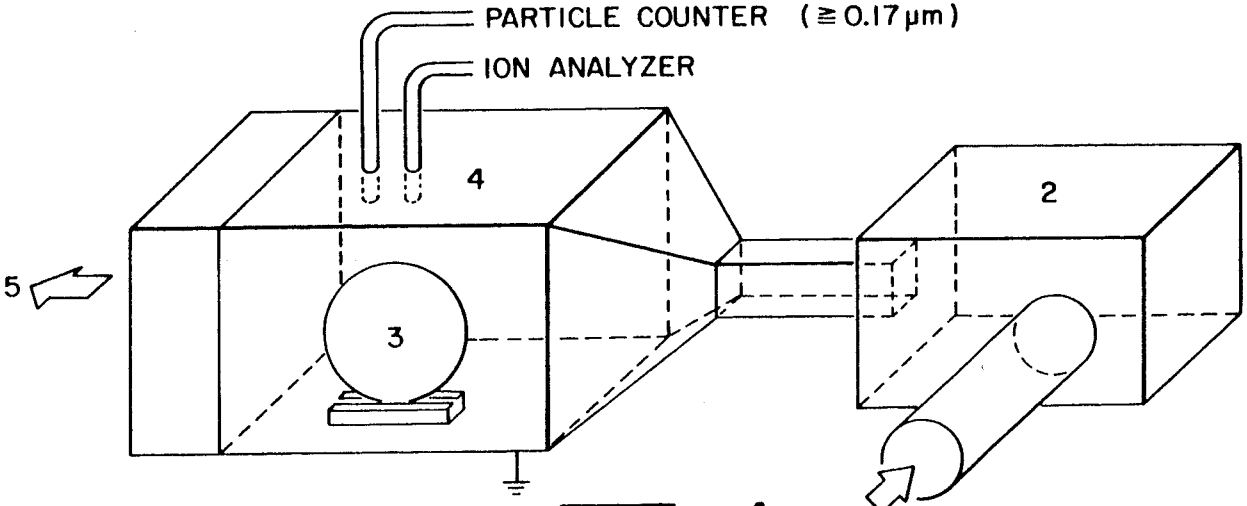
FIG. 4 is a perspective view of a neutralizing device according to an embodiment of the present invention.

FIG. 4 shows a neutralizing device according to an embodiment of the present invention. With this device, negative ions were generated by making use of a photoelectric effect, and an experiment was carried out to check an effect of negative ions to neutralize a positively electrified object.

FIG. 4, 1 is irradiation of an ultraviolet ray, 2 is an aluminum chamber, 3 is a silicon wafer, 4 is a wafer neutralizing chamber, and 5 is an air flow.

This experiment was carried out in the air in which the density of particles with a diameter of 0.17 μm or more was 0. The negative ions were generated by making electrons released from the aluminum wall by means of irradiating a ray 1 with a wavelength of 200 nm emitted from a Xe lamp into an aluminum chamber 2.

In this case, the maximum energy of the ray and ionizing energy of the aluminum are 6.2 eV, and 6.0 eV respectively. A rate of i on generation by this device is about several tens of millions pcs/sec for negative ions and a half of it for positive ions. The generation rate of negative ions can be controlled by changing a quantity of irradiated ray. In this experiment, positive ions are generated because impurities (with the ionizing energy of 6.2 eV or less) in the air are ionized.

Figure 5:
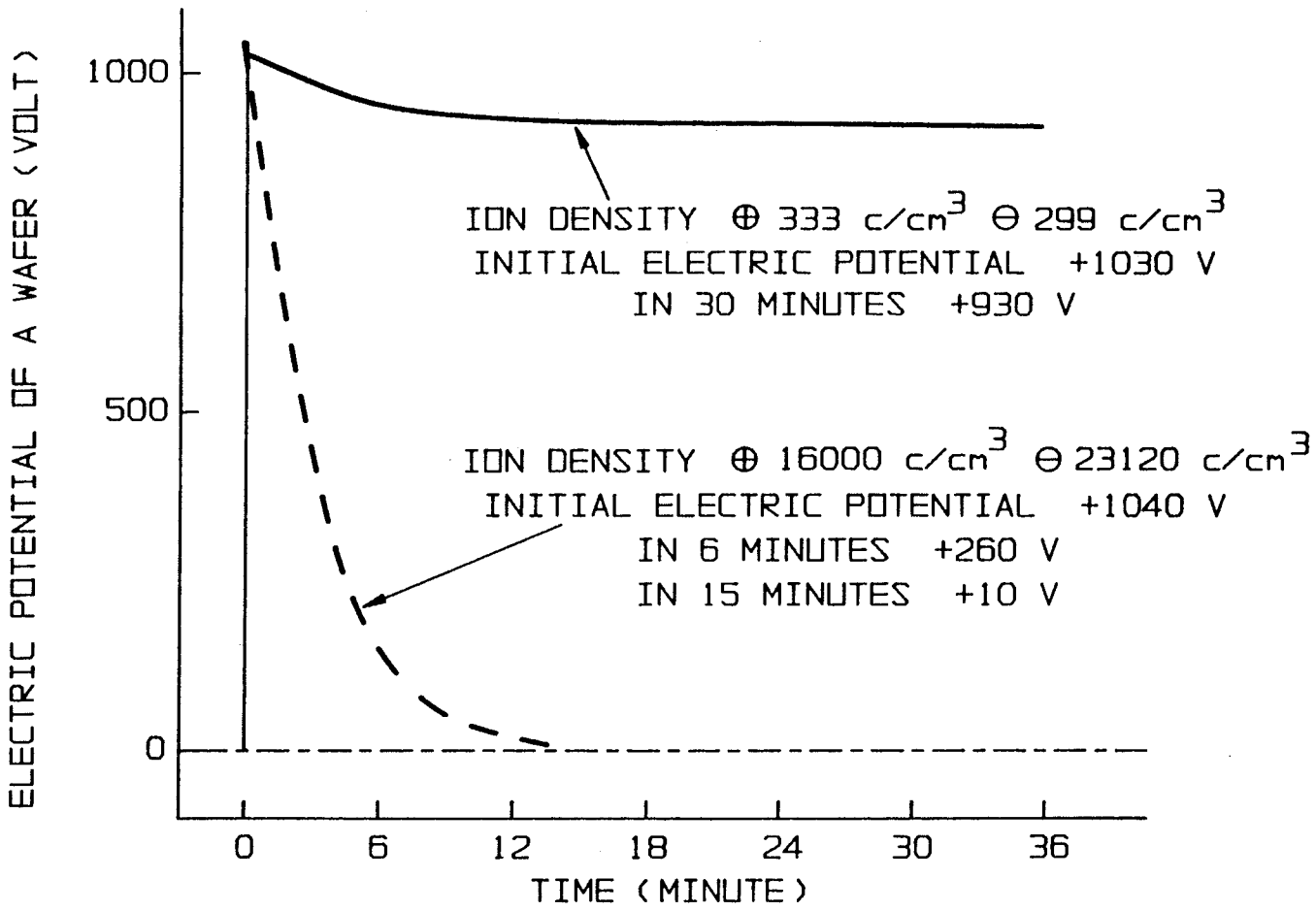
FIG. 5 is a graph showing results of an electrified wafer neutralizing experiment according to said embodiment.

FIG. 5 shows results of an experiment to neutralize an electrified wafer with ions. This experiment was carried out under 2 sets of conditions with different ion density (the ion density in one set was 100 times or more higher than that in other set), and effectiveness of ions for neutralizing an electrified wafer was investigated. In FIG. 5, a solid line shows an attenuation effect of electric potential in an electrified wafer in the atmosphere with a negative ion density of about 300 pcs/cm$^3$. In a wafer with a initial electric potential of +1030 V, the electric potential went down only to +930 V even in 30 minutes. On the other hand, in the case where a density of negative ions generated by means of the ion generating method according to the present invention was about 23,000 pcs/cm$^3$, an initial electric potential of +1040 V in a 5-inch wafer went down to +160 V in 6 minutes, and to +10 V in 15 minutes, which means a rapid attenuation. With high ion density, it is possible to make the attenuation speed faster. The results indicated that neutralization by negative ions is very effective to prevent an object, which is apt to be positively electrified, from being electrified. Note that, although, in this embodiment, an Xe lamp was used as a light source and aluminum as an irradiated object, other light sources and other irradiated objects are available for neutralization of an electrified object. Materials with small ionizing energy, or in other words with a small work factor are available as irradiated objects. Such a material as barium oxide (BaO) which has been used as a material for a cathode of an electron tube is also available for this purpose. A mercury lamp is also available for this type irradiated objects. A wavelength of a representative ray emitted from a mercury lamp is 253.9 nm. A light source used in this invention emits a ray having a wavelength element with high energy than a work factor of an irradiated object.

Figure 6:
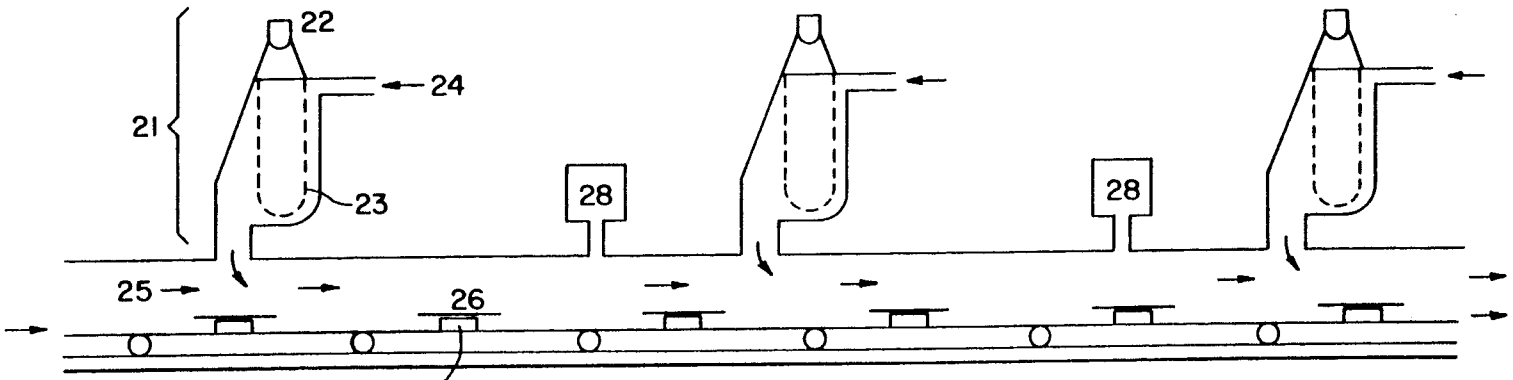
FIG. 6 is a perspective view of a neutralizing device according to another embodiment of the present invention assuming a wafer transfer tunnel in an LSI manufacturing plant.

An example of a wafer electric potential neutralizing system assuming an actual LSI production line is shown in FIG. 6. FIG. 6 shows a method for neutralizing electric potential of a wafer being transferred through a clean $N_2$ wafer transfer tunnel. In this case, ion generating devices are arranged at an equal interval in the wafer transfer tunnel to continuously supply ions into the transfer tunnel. In the ion generating device, a material which generates a photoelectric effect when irradiated by a ray is based on a mesh construction or a honeycomb construction. In this case, if too many mesh sheets are overlaid, generated ions are absorbed by the mesh sheets, and for this reason, a number of mesh sheets must be set so that an ion density in the downstream from the ion generating chamber will be maximum. Also this is true for roughness of a honeycomb construction. An ion generating rate is controlled photoelectrically. As a source of negative ions, gas which does not contaminate a wafer to be neutralized even if it adheres to the wafer (with positive, yet relatively low electronic affinity: e.g., hydrogen gas) should be used. As for an ion density in a wafer transfer tunnel, an ion generating rate is controlled by continuously monitoring ion analyzers arranged in the tunnel. The ion density in the wafer transfer tunnel is set according to a control value for electric potential of the wafer. As a volume of gas supplied from the ion generating devices can be set to a fairly lower level than an atmospheric gas flow rate level in the tunnel, so that a difference of gas flow speed between a upstream section of the tunnel and its downstream section is not so large.

According to the present invention, objects which are always positively electrified can be neutralized efficiently. Although, in case of corona discharge method, such contaminants for an electrified object as corpuscles and ozone are generated, the present invention makes it possible to prevent generation of corpuscles and ozone. Namely, electrification of an object can be prevented without contaminating the object, and for instance, it is possible to sharply reduce low yield due to adhesion of particles at an LSI production site.

We claim:

1. A method of neutralizing an electrified object, comprising the steps of:
   - releasing electrons from an irradiated object by use of a photoelectric effect;
   - combining the released electrons with gas-state atoms or molecules to generate negative ions; and
   - neutralizing a positive electric charge in an electrified object by the negative ions.

2. An electrified object neutralizing device, comprising:
   - means for releasing electrons from an irradiated object by use of a photoelectric effect;
   - means for irradiating a ray onto said electron-releasing means;
   - means for generating negative ions by combining said released electrons with gas-state atoms or molecules; and
   - means for neutralizing an electric charge in an electrified object with said negative ions.

3. The device of claim 2, wherein said means for making electrons comprises a material with low ionizing energy and characterized in that said ray is an ultraviolet ray with a short wavelength.

* * * * *